US006763910B2

(12) United States Patent
Cole

(10) Patent No.: US 6,763,910 B2
(45) Date of Patent: Jul. 20, 2004

(54) SAFETY ROOF STRUCTURE INCLUDING SAFETY STANCHIONS

(75) Inventor: Barry A. Cole, Thornton, CO (US)

(73) Assignee: MC Enterprises International, Inc., Denver, CO (US)

( * ) Notice: Subject to any disclaimer, the term of this patent is extended or adjusted under 35 U.S.C. 154(b) by 5 days.

(21) Appl. No.: 10/187,161

(22) Filed: Jun. 28, 2002

(65) Prior Publication Data

US 2003/0006094 A1 Jan. 9, 2003

Related U.S. Application Data

(60) Provisional application No. 60/303,624, filed on Jul. 6, 2001.

(51) Int. Cl.[7] ..... A47L 3/04; E04G 1/36

(52) U.S. Cl. ..... 182/3; 182/45; 182/113; 248/237; 52/736.1; 256/59; 256/DIG. 6

(58) Field of Search ..... 182/3, 36, 4, 45, 182/112, 113, 150, 82; 52/125.4, 127.2, 736.1; 256/DIG. 6, 59, 65, 67; 248/237

(56) References Cited

U.S. PATENT DOCUMENTS

| | | | | | |
|---|---|---|---|---|---|
| 3,880,405 | A | * | 4/1975 | Brueske | 256/59 |
| 4,437,642 | A | * | 3/1984 | Holt | 249/175 |
| 4,603,522 | A | * | 8/1986 | Johnson | 52/125.4 |
| 4,607,724 | A | | 8/1986 | Hillberg | |
| 4,674,596 | A | | 6/1987 | Weiner et al. | |
| 5,182,889 | A | * | 2/1993 | Johnson | 52/298 |
| 5,287,944 | A | | 2/1994 | Woodyard | |
| 5,337,855 | A | * | 8/1994 | File | 182/150 |
| 5,346,036 | A | * | 9/1994 | Arisman et al. | 182/3 |
| 5,350,037 | A | | 9/1994 | Ghahremani | |
| 5,353,891 | A | * | 10/1994 | Griek et al. | 182/45 |
| 5,431,372 | A | * | 7/1995 | Kostelecky | 256/64 |
| 5,647,451 | A | * | 7/1997 | Reichel | 182/45 |
| 5,694,720 | A | | 12/1997 | Walcher et al. | |
| 5,711,398 | A | | 1/1998 | Bartholomew | |
| 5,730,407 | A | | 3/1998 | Ostrobrod | |
| 5,896,944 | A | * | 4/1999 | McMillian et al. | 182/45 |
| 5,975,239 | A | | 11/1999 | Casteneda | |
| 6,036,146 | A | * | 3/2000 | Paterson | 248/125.2 |
| 6,038,829 | A | * | 3/2000 | Franks | 52/645 |
| 6,098,746 | A | | 8/2000 | Casteneda | |
| 6,173,809 | B1 | | 1/2001 | Cole | |
| 6,336,623 | B1 | * | 1/2002 | McCarthy | 256/64 |

* cited by examiner

*Primary Examiner*—Hugh B. Thompson, II
(74) *Attorney, Agent, or Firm*—Brian D. Smith, P.C.

(57) ABSTRACT

Roof structures including safety stanchions for mounting directly to the roof of a building are disclosed. One disclosed safety stanchion has a cross-shaped base for mounting the stanchion on the surface of a roof or glass skylight supported by crisscrossing rafters and purlins. Another roof structure includes safety stanchions having inelastically deformable and replaceable components, crisscrossing rafters and purlins for supporting a roof surface and a structural member for supporting the rafter(s). This roof structure defines an opening extending through the rafter for receiving the stanchion's rigid elongated base which extends through the opening and is attached at its lower end to the structural member supporting the rafter(s).

15 Claims, 5 Drawing Sheets

SAFETY ROOF STRUCTURE INCLUDING SAFETY STANCHIONS

CROSS-REFERENCE TO RELATED APPLICATIONS

This application is a nonprovisional application claiming the benefit under 35 USC 119 (e) of U.S. provisional application Ser. No. 60/303,624, filed on Jul. 6, 2001.

TECHNICAL FIELD

The present invention relates generally to products and methods for providing fall protection systems for construction workers, maintenance workers, inspectors and others who work or walk upon elevated structures. More particularly, it relates to fall protection systems which employ safety stanchions mounted to the elevated structure so as to anchor and support safety cables (commonly known as horizontal lifelines).

BACKGROUND OF THE INVENTION

It is common for workers to work and walk upon the roofs (which include large commercial skylights) of commercial buildings, which are flat and of varying slopes—some of which are quite severe. Obviously, it is important but often difficult to protect such workers and others from harm if they happen to slip and fall off the roof. It is common during the construction phases and during repair and replacement of roof structures, that the roof surface will have holes in the interior sections of the plane of the roof. Thus, falls to the interior of the building as well as off the edge of a roof are ever present dangers.

It is also important, for the purpose of controlling costs, that any fall protection system which is put in place to protect the workers be relatively inexpensive and easy to install and cause little interference with the work being carried out by the workman. Further, the fall protection system should also preferably be adaptable to virtually any roof, whether the roof is very rigid and uses more massive structural components such as those made with structural beams and joists, or the roof is relatively lightweight and designed for movement or flexion (such as a large skylight canopy), or the roof is for a lightweight metal building, which are characteristically made with lighter weight rafters and purlins. Some roof systems employ poured concrete on top of metal decking, and it would be desirable if a fall protection system were mountable to these systems as well.

Most conventional fall protection systems to which the present invention relates involve systems for supporting the worker (after a fall) with a safety cable that may be anchored and supported in various ways. Once a safety cable is anchored and supported, workers may be assured that they will be suspended in the case of a fall by attaching themselves to the safety cable, as, for example, by way of a safety lanyard attached both to the cable and to a harness worn by the worker. However, virtually all such systems involve heavy structural attachments that penetrate the roof surface to attach to structural metal below and are also rigid and unyielding. This makes such systems undesirable and extremely expensive to install if a building owner wishes to retrofit his building with system after the structure has been erected, due to the potential for damage to interior tenants, and water infiltration during construction among other inconveniences typical to a significant remodeling project.

Moreover, after a fall arrest, a typical system is taken out of service, and it is likely that the safety stanchion posts of the system will have to be removed, inasmuch as the post as well as the mounting will have been subjected to severe forces and therefore are likely to have suffered damage. Obviously, replacement of the stanchions is objectionable for the same reasons described earlier with respect to the initial installation of such systems. Replacement is also objectionable due to the additional costs and potential damage to the building as a result of the repair.

Other conventional systems (such as that described in U.S. Pat. No. 5,287,944 to Woodyard) (which is commonly employed only during construction of wood roofs) employ a large obtrusive plate that keeps the cable so low and slack so as to lay and flop against the roof surface. This is unacceptable to builders, manufacturers, and owners of finished long life roof systems made of coated sheet metals and glass. If a structure such as Woodyard's were increased in height the increased leverage would likely rip it off the roof, thus rendering it unreliable as well as larger and harder to attach and potentially causing more damage during installation. Indeed, a cable that is not adequately supported is potentially dangerous since it is likely to bang violently against the glass plates during a wind storm and potentially fracturing the glass and injuring people. If the cables are tightened, (for instance to get rid of some sag) the forces go up so significantly that the tension in the cable alone could cause damage to many roofs, even before the massive forces of a fall arrest event are applied. Therefore, it can be seen that there is a need for a system that has some height so as to keep the cable supported and off the roof; some means to support the cable at intermediate points that are not obtrusive nor expensive; does not require penetration of the roof structure; is aesthetically pleasing; allows for cable sag (or does not require cable tensioning) for reduced forces (but not so much that the cable begins to cause damage to the fragile glass, metal or other roof material); reduces forces by using sacrificial members and allows the cables to be lowered during a fall arrest to reduce leverage and force at the end points—with the feature of having the sacrificial parts easily replaceable without having to further disturb the roof system and penetrate the building which exposes the tenants and the owners to potential damage and delay. Further, the system is preferably lower cost and easier to install due to surface mounting rather than requiring significant penetration of the roof to install.

Unfortunately, in many commercial buildings such as those of the type known as system metal buildings (also known as pre-engineered metal buildings or "Butler buildings") and large commercial skylights and canopies, workman must walk and work upon these sloped roofs where there are few or no suitable anchoring points for attaching safety cables. Many manufacturers of these structures do not have the expertise to design fall protection systems and many shy away from the liability, assuming safety systems are complex and require significant maintenance. Most commercial buildings in service today, and even those currently under construction still do not have any type of safety or fall protection roof structure installed.

A previous invention of which I am a co-inventor and which is described in U.S. Pat. No. 6,173,809 provides a safety stanchion for mounting upon a surface such as structural I or H shaped beam which are typically found in the superstructure of a bridge, a building or some other structure being built.

This safety stanchion includes a tapered tubular post having a lower end for attachment to a support base at preferably an oblique angle and an upper end for supporting a safety cable and the like. Due to its tapered shape, the post's upper end has an outside diameter which is less than that of its lower end. The post also preferably has a wall thickness of less than 0.125 inches and is frustoconically shaped. In addition, the post is preferably made out of an energy absorbing, elastic-like, high strength steel such as A595 grade steel which in cooperation with the post's wall thickness and tapered, preferably frustoconical, shape is believed to render the post capable of inelastically deforming before it fails, thereby better able to break a worker's fall without actually breaking in half. Fail or failure of the post as used herein refers to a post which has actually broken or buckled to a point where it is no longer capable of providing any significant resistant to lateral forces or other forces tending to cause bowing of the post.

In the preferred safety stanchion of this type, the tapered post is capable of flexing and permanently (or inelastically) deforming without failing, in response to sudden loads (within its design limits) that might occur when a person who is attached to the stanchion (or a cable suspended between two stanchions) via a lanyard falls from an elevated beam or similar surface upon which the stanchion is mounted.

While the invention of the '809 patent is easily attachable to I beams and other structural members, a need still exists for safety stanchions and safety stanchion systems which are attachable to sloped roofs, particularly those of the type which are supported by crisscrossing rafters and purlins, are lightweight sheet metal, and commercial skylights that are commonly made of lighter weight materials.

In addition to roof surface attachability, there is a need for a system that is simple, low profile so as to be aesthetically pleasing—or at least be aesthetically unobtrusive when installed on decorative roofs and skylights, and made of materials that are low maintenance and long lasting. The system ideally has easily replaceable parts that because of sacrificial shock absorbency enable components to be salvaged after a fall arrest and which after replacement allow the fall protection system to placed back in service in a short period of time without extensive new construction or repairs to the mounting means or the system's major components.

DISCLOSURE OF THE INVENTION

The present invention builds upon the invention of the '809 patent and the prior art by providing a unique safety roof structure including unique safety stanchion apparatus' for mounting directly to the roof of a building, particularly those typically found in commercial buildings and skylights and supported by crisscrossing rafters and purlins.

One unique safety stanchion of the present invention includes a post having first and second ends, means for supporting a safety cable at said first end of said post and a base at the second end of the post for mounting the post on a generally flat surface portion of a flat or sloped roof or glass skylight supported by crisscrossing rafters and purlins.

In a preferred embodiment of this safety stanchion, the base includes a mounting plate having a cross shape for aligning with and being supported by the crisscrossing rafters and purlins of the roof structure supporting a generally flat sloped roof. The mounting plate is attachable to at least one of said crisscrossing rafters and purlins. However, if the rafters are strong enough, the cross shaped mounting plate may be replaced with a simple elongated plate for attachment solely to the rafter. In these embodiments, any or all of the post, base and means for supporting a safety cable at said first end of said post means may be sacrificial in the sense that is capable of inelastically deforming or bending without failing during a workman's fall as such is described in the '809 patent.

The present invention as set forth in the claims appended hereto also provides a unique safety roof system or structure which includes crisscrossing rafters and purlins for supporting a roof or glass skylight surface and a plurality of the aforementioned safety stanchions.

The present invention also provides another unique safety roof system which additionally includes a structural member for supporting a rafter (also sometimes referred to as a beam) which defines an opening extending through the rafter. This roof structure also includes a plurality of safety stanchions. However, the stanchions of this roof structure differ from that previously described in that the stanchion is provided with an elongated rigid base that extends through the opening provided in the rafter and is attached at its lower end to the structural member supporting the rafter.

The post of this stanchion may also be sacrificial in the sense that is capable of inelastically deforming or bending without failing during a workman's fall as such is described in the '809 patent. In addition, the second or lower end of this sacrificial post is preferably removably fastened to the upper end of the rigid elongated base. This allows the post to be easily removed and replaced if it becomes deformed as a result of a workman's fall and allows the base to remain for the life of the roof structure, virtually unaffected by successive falls upon the sacrificial upper end pieces. Any common post which does not have this feature is likely to cause so much strain on the roof (due to the raised lever action common to most posts) that a fall will cause damage to the roof structure and after a fall is likely to be out of service for extensive periods of time while roof construction or repair specialists are recruited to repair the damage caused and to replace the stanchions. Also and as with most safety stanchions, the post defines or has attached to its first or upper end a means for supporting a safety cable which may simply consist of a hole defined by the post's upper end to which the safety cable is attached. This roof structure may also include a plurality of the aforementioned safety stanchions having cross-shaped bases and when so used in combination provide multiple benefits including allowing cables to be positioned relatively low over the top of the roof structure while still preventing the cable from damaging glass skylights or painted sheet metal (for example when the wind buffets the cables), rendering an area of the roof safe for users to tie off and ease of tie off with a slightly elevated cable, while being capable of sacrificially bending to reduce forces on a worker and reducing the forces on the base and thereby assuring with some certainty that the roof structure is not damaged. Further, the grouping of a series of posts and end attachments into separate systems (a series of posts and sacrificial end attachments as opposed to a single long lifeline with only two terminations) allows more than one set of workers to perform work with another set of workers, each pair (typically two to three workers per system) being attached to different safety lines. In the event one worker falls and his partner where to be pulled off or fall with him, the adjacent sets of cables could be used to provide fall protection for other workers to rescue the fallen workers. Other benefits of multiple bases include force reduction and reduced lifeline loading (generally more posts will reduce lifeline forces), while the pass-through design allows continuous movement of the workers without the aggravation of hooking a second lanyard over the top of an intermediate point before disconnecting a previously attached first lanyard. The multiple intermediate series of posts also allows for clearance of the cable above the glass skylight or other roof material while allowing for sufficient horizontal lifeline sag which again adds some shock absorbency and reduces force factors. Finally, the system supplies the support needed to make the system effective, safe, and aesthetically pleasing.

The present invention also provides a safety stanchion apparatus that can be mounted to a flat surface on virtually any roof. This safety stanchion has a rigid and generally nondeformable base but the stanchion's post or its cap or means for supporting the safety cable is removable and capable of inelastically deforming before failing. This enables a deformed (i.e. sacrificed) component of the stanchion to be replaced without having to replace the entire stanchion which is not only expensive but also more difficult and unsafe than simply replacing a component (post or cap) of the stanchion. The base also has a generally flat underside surface for attachment to a generally flat section of a roof.

BRIEF DESCRIPTION OF THE DRAWINGS

The accompanying drawings illustrate and provide views of preferred embodiments of the present invention. Other features, objects and advantages of the present invention will appear in and be apparent from the following detailed description, when reference is made to the accompanying drawings.

In the accompanying drawings.

DETAILED DESCRIPTION OF PREFERRED EMBODIMENTS

Figure 1:
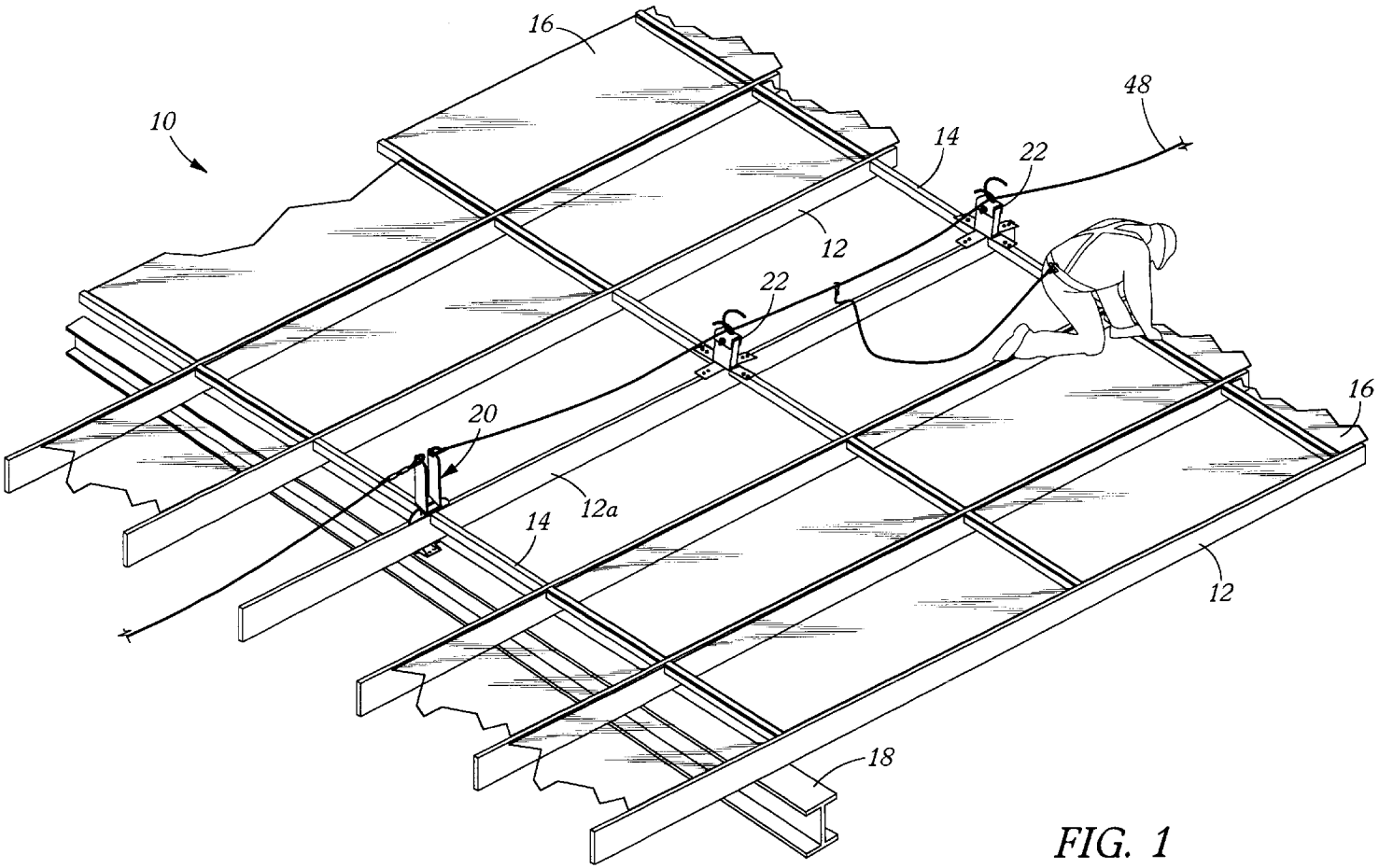
FIG. 1 is a perspective view of a safety roof system or structure of the present invention which is provided with safety stanchions for restraining a workman's fall. The shown transparent glass surface is typical of a skylight, and metal, wood, or other roofing materials may be substituted as well.
Figure 2:
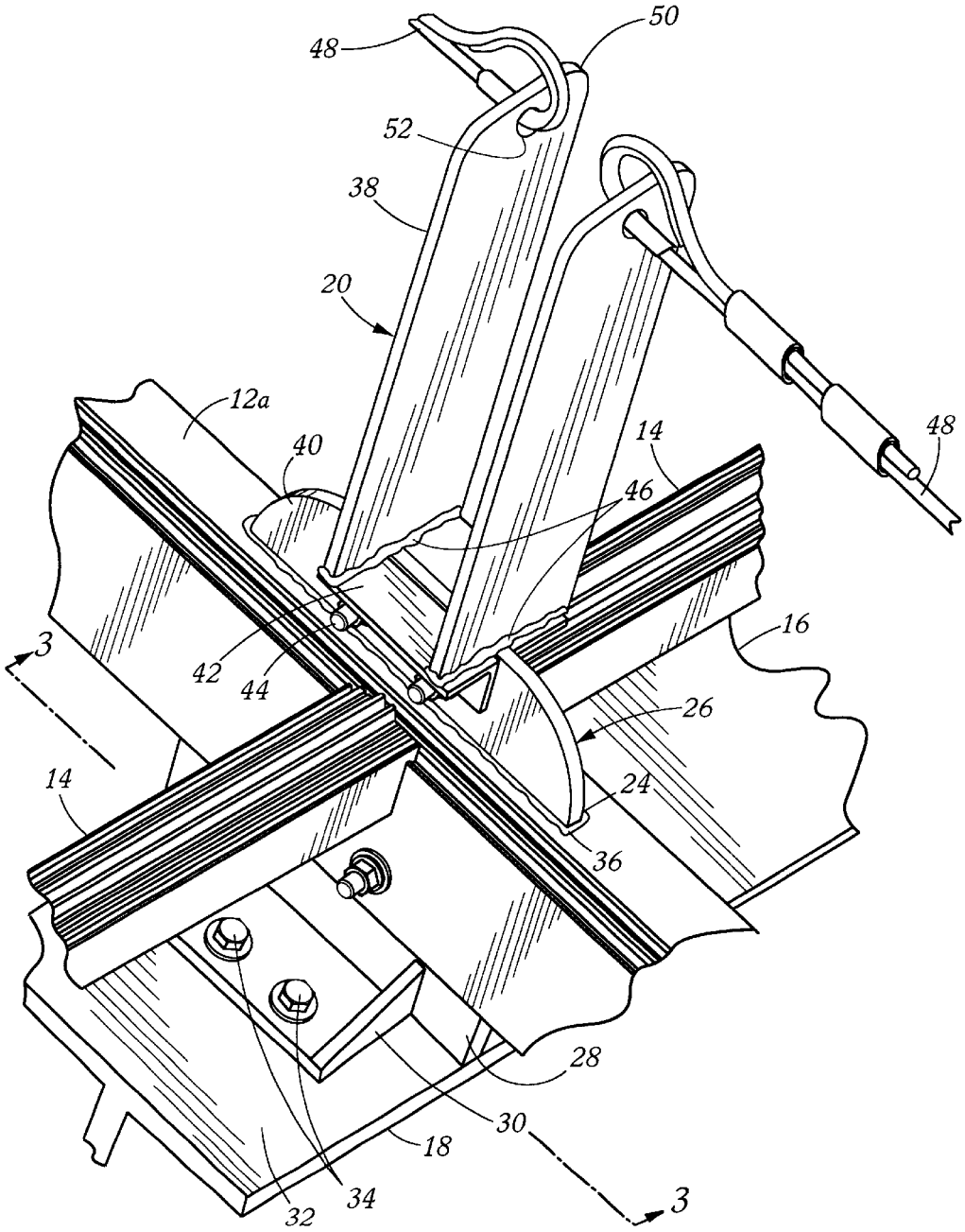
FIG. 2 is an enlarged perspective view of one of the safety stanchions of the roof structure of FIG. 1.
Figure 3:
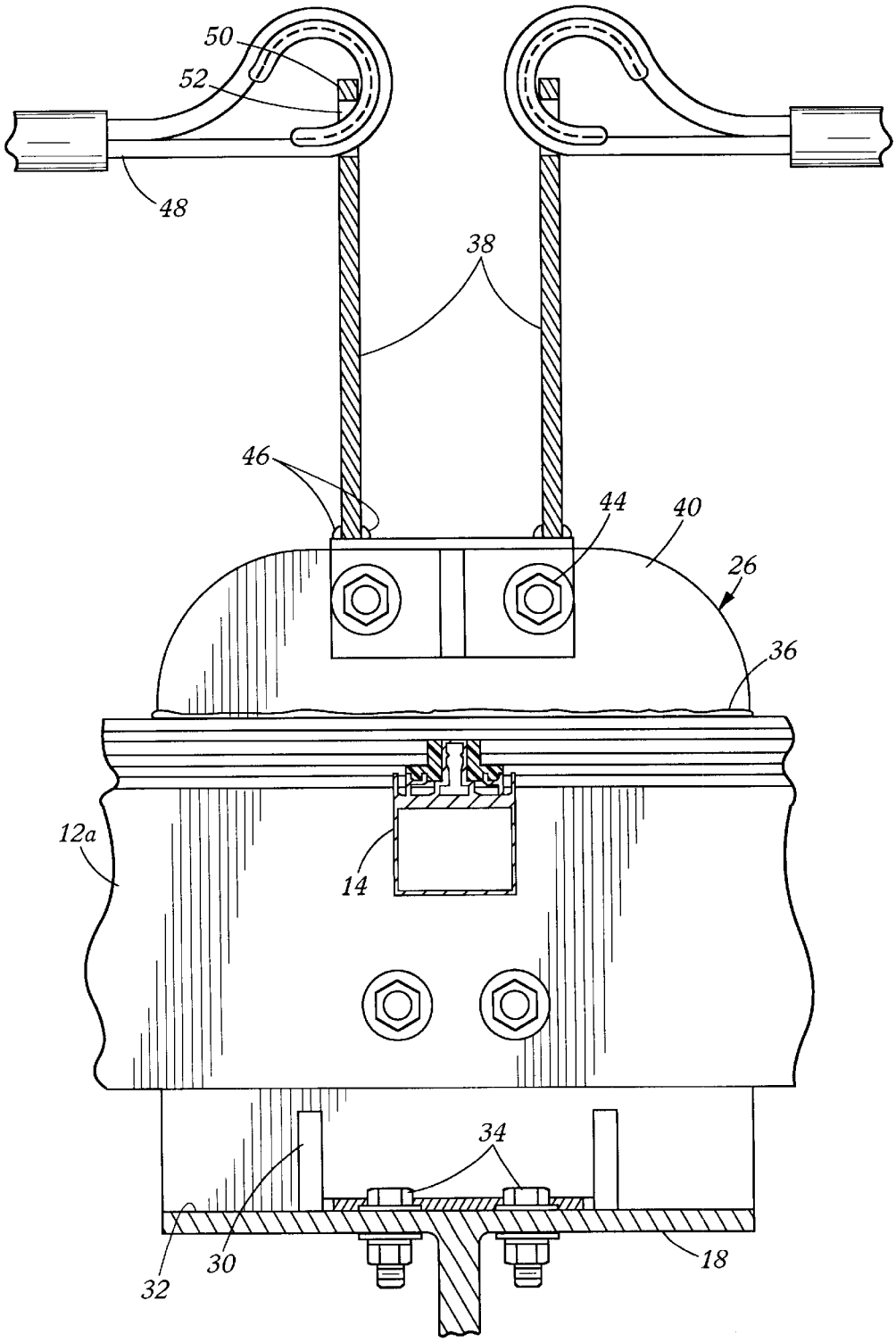
FIG. 3 is a cross-sectional view of FIG. 2 taken along lines 3—3 of FIG. 2.

FIGS. 1–3 illustrate a safety roof structure or system 10 of the present invention which in its most general sense includes three main components: (1) crisscrossing rafters 12 and purlins 14 for supporting a roof surface 16 which as shown in the Figure is transparent; (2) a structural member 18 for supporting at least one of the rafters 12 (the supported rafter being identified as rafter 12*a*) and (3) a plurality of first safety stanchions 20 and second safety stanchions 22 for supporting safety cable(s) 48.

As best illustrated in FIG. 2, rafter 12*a* supported by structural member 18 defines an opening 24 which extends through the rafter. As also illustrated, an elongated rigid base or base plate 26 of a stanchion 20 extends through opening 24 of the rafter and is attached at its lower end 28 to the structural member 18 supporting the rafter. As shown in FIGS. 2 and 3, base plate 26 has an integrally attached gusset containing bracket 30 which is preferably welded to the lower end 28 of the plate and which secures the base plate to the top surface 32 of the structural member 18 with two pairs of fasteners 34, with a pair of fasteners 34 located on each side of the base plate. As also shown, the opening 24 of the rafter 12*a* receiving base plate 26 is sealed with a bead of caulk 36 to prevent moisture from entering the rafter.

Turning now to the remainder of stanchion 20, it will be appreciated that stanchion 20 is provided with a pair of upright plates or posts 38 which are secured to the upper end 40 of the base plate 28 with a bracket 42 which is bolted to the upper end with a pair of fasteners 44. Plates 38 are attached to bracket 42 and done so preferably by welding the plates to the bracket as indicated by the weld bead 46 which is best illustrated in FIG. 2. Each plate/post 38 supports the end of a safety cable 48 at the plate's upper end 50 which is provided with a hole 52 to which the end of the safety cable is secured. Other means known to those skilled in the art for attaching the safety cable to the upper end of the plate/post may also be employed. Moreover, it will be appreciated that as few as one and more than two upper plates 38 may be utilized in different directions (around 360 degrees concentric to base 26 to accommodate different segments of horizontal lifelines that may cover different roof areas.) In addition, the upper plates could be of any size and shape (for instance tubular such as a pipe section, solid round or square rod to accommodate the design criteria, and could function similarly.)

The plate or post 38 of this roof structure is also sacrificial in the sense that is capable of inelastically deforming or bending without failing during a workman's fall as such is described in the '809 patent which is hereby incorporated by reference. By using the aforementioned fasteners 44 to attach the plates/posts 38 to the upper end 40 of the rigid elongated base, the plates/posts may be easily removed and replaced if one becomes deformed as a result of a workman's fall. As might be appreciated by observing FIG. 2, plates 38 could also be turned 90 degrees and directly attached to the upper part 40 of the base 26 by passing fasteners 44 through holes (not shown) drilled in the lower part of the plate 38 that align with those for fasteners 44 in base 26.

Plate/post 38 is preferably constructed from stainless steel of ⅛" to ¾" thickness. However, as previously disclosed it is possible and may be desirable in some situations to construct the post from rod, pipe or other tubular members from other steel or composite or structural materials that have a high tensile strength to allow flexion and a large capacity to withstand, without fracturing, both flexion and permanent deformation when subject to the extreme forces of a worker's fall as transmitted through a horizontal lifeline or when attaching directly to the plate using a lanyard.

The plate/post 38 is constructed so as to flex (elastically) (such as when a worker inadvertently slips and slides on a roof but does not fall, and (if the load is sufficiently high) to permanently deform, controllably and without fracturing, in response to a substantial load (within its design limits) that is suddenly exerted upon it, as for example by the fall of a worker (or more than one worker (for instance two workers) that might fall simultaneously) who is/are being suspended by a safety cable attached to a safety stanchion.

It should also be noted that it may not always be necessary to attach two separate safety cables to safety stanchion 20 as shown, and for some applications (i.e. when supporting a single cable or when used as an end point) the stanchion would need to support only a single cable. Such a stanchion would only need and therefore only be provided with one plate/post 38. Similarly, a central stanchion could be fitted with four or more cables in generally radial directions 360 degrees around its center depended on the users needs for coverage and the design factors of the system.

Figure 4:
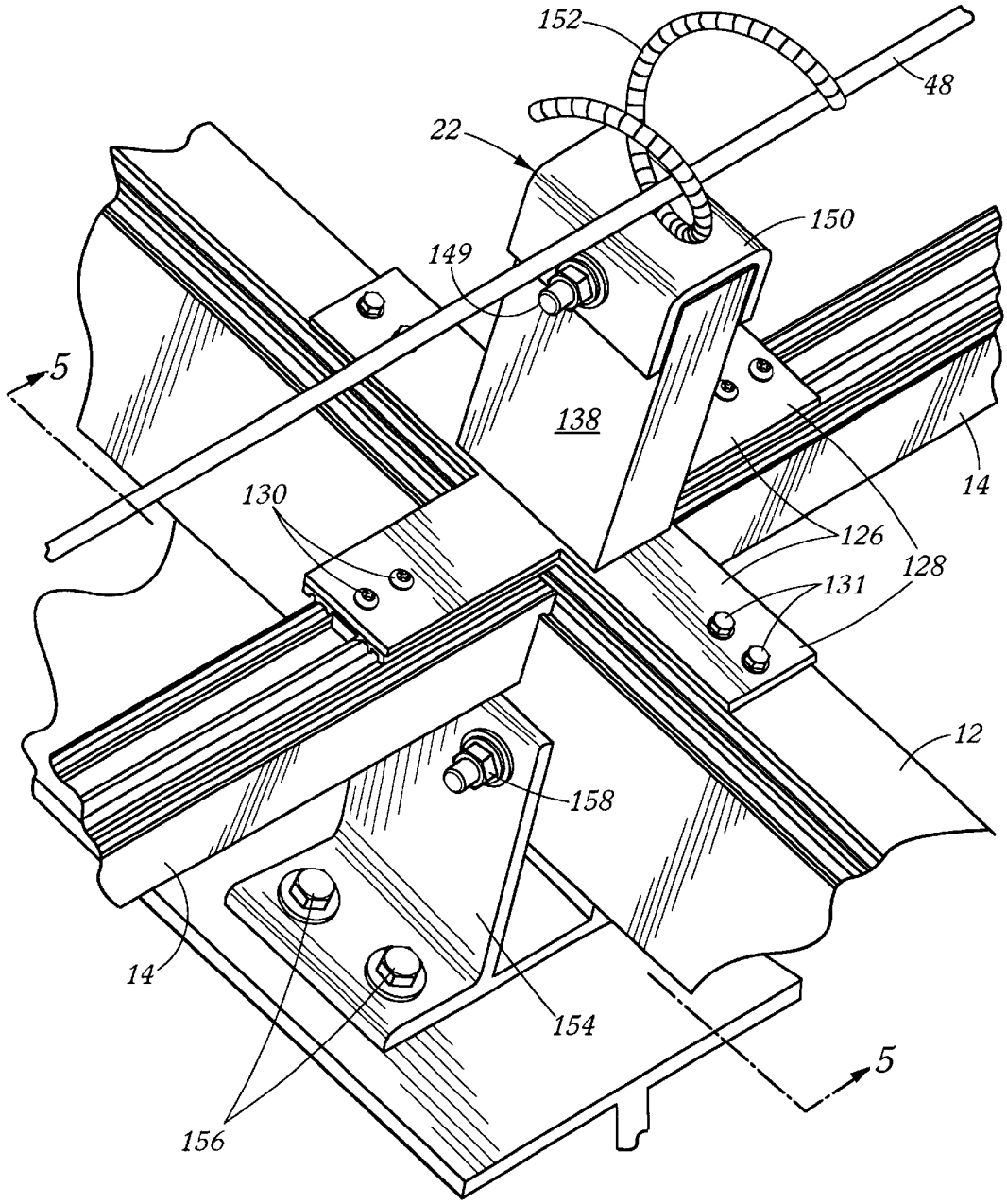
FIG. 4 is an enlarged perspective view of another safety stanchion employed in the roof structure of FIG. 1. While not shown in FIG. 1, this rafters and purlins supporting this stanchion may also be supported by a structural member as shown in this view.

Roof structure 10 also preferably includes a plurality of the aforementioned safety stanchions 22. As best illustrated in FIG. 4, each stanchion 22 has a cross-shaped base plate 126 which allows the plate to align with and be supported by the crisscrossing rafters and purlins of the roof structure at the location where the rafters and purlins cross or are joined to each other. As also shown, each leg or section 128 of the cross shaped base 126 is attached to its respective rafter or purlin with a pair of fasteners 130, 131. In addition, the stanchion's cross-shaped base supports and is attached, preferably welded, to the stanchion's upright post 138 which while not shown is preferably a hollow tubular structure capable of resisting the loads of the cables that attach or travel through a cap 150. The upper end of the post supports and is attached by a fastener 149 to a cap 150 for supporting safety cable 48. Cap 150 is of the pass-through type similar to that taught by U.S. Pat. No. 4,037,824 except that this invention uses horns 152 that are designed to inelastically deform and bend which is not taught in '824 patent. Horns 152 allow a workman to pass his lanyard through the cap without removing the lanyard as he/she walks by the stanchion. In the case of an open pass-through type the energy absorbing qualities of the deformable horns are beneficial to the system in that the horns initially and during use serve to support the cable and allow workers mobility and security of always having an attachment to the cable, but during a fall resist the angular loads of a person falling between two stanchions, and allow the cable to bend around the horns and transmit the forces back to the cable end anchorage. If the forces are high enough, (such as might occur when two heavy workers fall simultaneously) the horns may beneficially bend open without breaking and allow the cable to sag more, which in turn acts as an intermediate shock absorbing component of the overall system.

Figure 5:
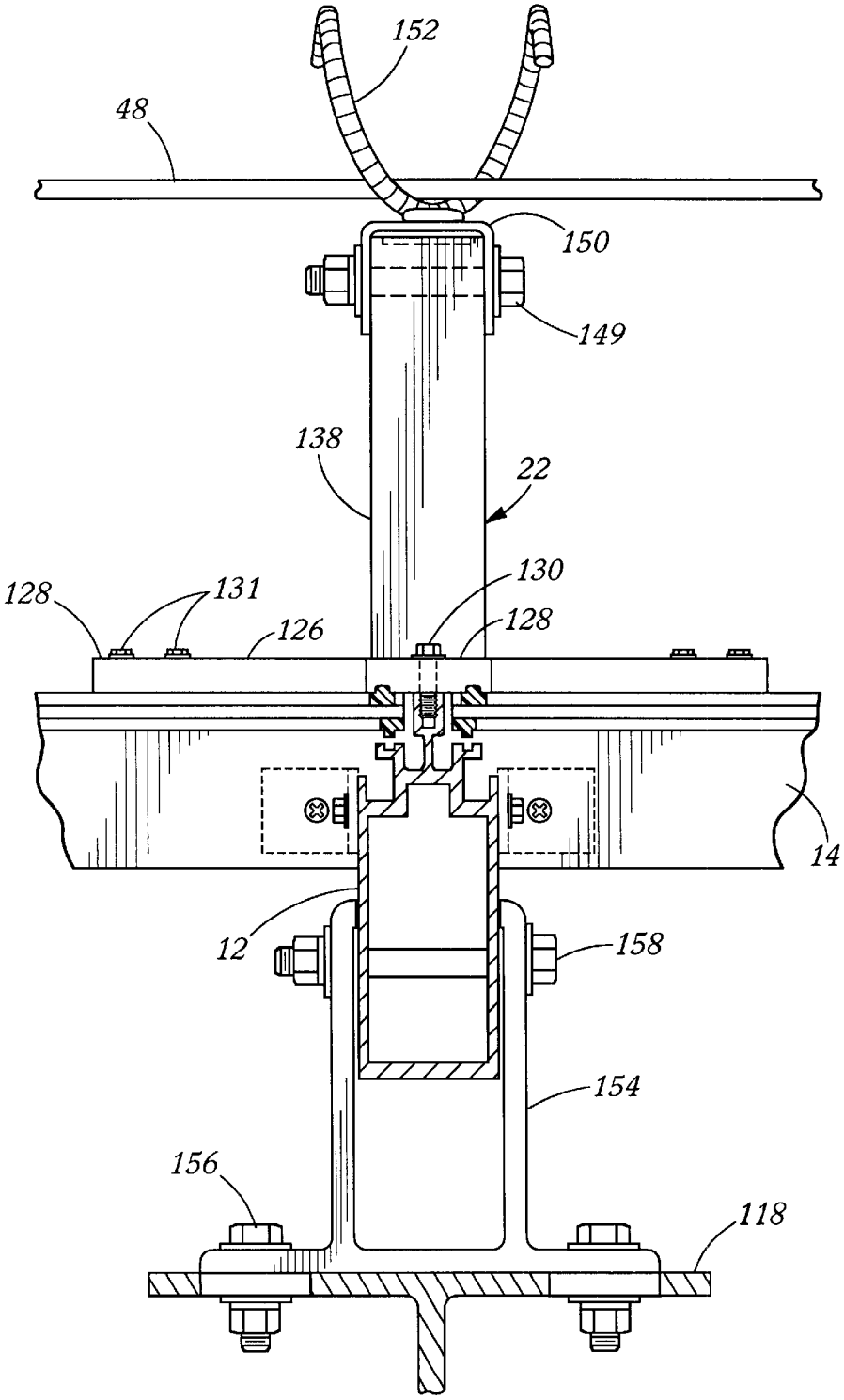
FIG. 5 is a cross-sectional view of FIG. 4 taken along lines 5—5 of FIG. 4.

Cap 150 could also be fitted with a rigid solid ring, or plate with a hole for supporting the cable that would not be capable of sacrificially bending and absorbing forces, in which case the cross-shaped base and the stanchion could be designed to resist the loads. Further, the cross-shaped base and stanchion could be fitted with attachable bendable sacrificial plates 38 as described previously in the embodiment of FIGS. 2 and 3 and thereby serve as an end point for one or more cables. FIGS. 4 and 5 also show that if support for the roof structure and or the stanchion 22 is necessary a rafter 12, supporting the stanchion may itself be supported by a structural member 118 which supports the rafter with a pair of brackets 154 extending between and attached to the top of the structural member with fasteners 156 and the sides of the rafter with fasteners 158. It will be appreciated that design factors would allow structural member 118 to be larger or smaller depending on design forces transmitted from the safety stanchion system or the combined effects of the weight of the roof (and for instance snow loads), vibration, wind, workers, fall arrest forces in the safety system, and other imposed loads.

It will also be appreciated that fasteners 130 are bolts and fasteners 131 are screws but the fasteners could also include concrete anchors, a combinations of these, or other means for attaching to the various types of roofing or glass skylight systems. Fasteners 130, 131 may be fitted with washers or gaskets to provide resistance to water penetration, and the base 126 may be embedded in caulk, or a bead of caulk or a gasket may be used under or around the base for resistance to water.

It will also be appreciated that the cross-shaped base may be modified such that its legs 128 are not exactly ninety degrees apart from each other. This would allow the base to accommodate various angles of rafters and purlins which are provided sometimes when a skylight is shaped like a hexagon or a triangle. Further, the legs of the cross-shaped base may be longer or shorter to accommodate the strength of the members below.

While preferred embodiments of the present invention have been shown and described, it is to be understood that this was done only by way of example, and not as a limitation upon the scope of the invention and, of course, it goes without saying that any number of safety stanchions 20, 22 as well as modified versions of stanchions 20, 22 can be adaptable and easily mounted with fasteners on most any roof having rafters, purlins, beams, joists, crisscrossing rafters and purlins or other different structure, without interruption, so that the fall protection system (or segments thereof) can be extended indefinitely.

I claim:

1. A safety stanchion apparatus for mounting to a roof or skylight structure having crisscrossing rafters and purlins, said safety stanchion apparatus comprising:

a post having first and second ends;

means for supporting a safety cable at said first end of said post, said means for supporting a safety cable having helically-shaped horns which are capable of inelastically deforming before failing; and a base at said second end of said post, said base including a mounting plate for being supported by a said rafter, said mounting plate also being attachable to said rafter.

2. The safety stanchion apparatus as claimed in claim 1 wherein said mounting plate is cross-shaped for aligning with and being supported by crisscrossing rafters and purlins, mounting plate also be attachable to at least one of said crisscrossing rafters and purlins.

3. The safety stanchion apparatus as claimed in claim 1 wherein said mounting plate has a plurality of holes extending through said plate and wherein said safety stanchion apparatus further comprises a plurality of fasteners for being passed through said holes to secure said mounting plate to said supporting rafter.

4. The safety stanchion apparatus as claimed in claim 1 wherein the length to width ratio of said post is less than 8 to 1.

5. The safety stanchion apparatus as claimed in claim 1 wherein said post is capable of inelastically deforming before failing.

6. A safety stanchion apparatus as claimed in claim 1 wherein said means for supporting a safety cable at said first end of said post is removable from said post.

7. A safety roof structure comprising:

crisscrossing rafters and purlins for supporting a roof surface or skylight; and a plurality of safety stanchions, each of which includes:

a post having first and second ends;

means for supporting a safety cable at said first cad of said post;

a base attached to said second end of said post, said base including a cross-shaped mounting plate for aligning with and being supported by said crisscrossing rafters and purlins, said mounting plate also be attached to at least one of said crisscrossing rafters and purlins.

8. The safety roof structure as claimed in claim 7 wherein said mounting plate has a plurality of holes extending through said plate and wherein said roof structure further comprises a plurality of fasteners for being passed through said holes to secure said mounting plate to at least one of said supporting rafters and purlins.

9. The safety roof structure as claimed in claim 7 further comprising safety cable for being supported by said safety stanchion apparatus.

10. A safety roof structure comprising:

crisscrossing rafters and purlins for supporting a roof surface or skylight;

a structural beam member for supporting at least one of said rafters, said rafter supported by said structural beam member defining an opening Which extends through said rafter; and a plurality of first safety stanchions, each of which includes:

a post having first and second ends;

moans for supporting a safety cable at said first end of said past wherein either said post or said means for supporting a safety cable is capable of inelastically deforming before failing; and a generally rigid elongated base extending trough said opening of said rafter, said base having an upper end and a lower end with said upper end attached to said second end of said post and said lower end attached to said structural beam member supporting said rafter.

11. The safety roof structure as claimed in claim 10 further comprising of second safety stanchions, each said second safety stanchion comprising:

a post having first and second ends;

moans for supporting a safety cable at said first end of said post;

a base attached to said second end of said post, said base including a cross-shaped mounting plate for aligning with and being supported by the crisscrossing rafters and purlins of the roof structure, said mounting plate also be attached to at least one of said crisscrossing rafters and purlins.

12. The safety roof structure as claimed in claim 11 further comprising safety cable for being supported by said first and second plurality of safety stanchion apparatus.

13. The safety roof structure as claimed in claim 10 wherein said post includes a fiat plate attached which is capable of inelastically deforming before failing.

14. The safety roof structure claimed in claim 13 wherein said flat plate is removable from said rigid elongated base.

15. The safety roof structure as claimed in claim 10 wherein said post includes a pair of flat plates, each of which:

a) supports the end of a different safety cable;

b) is capable of inelastically deforming before failing; and c) is removably fastened to said rigid elongated base.

* * * * *